US005129354A

United States Patent [19]

Koizumi et al.

[11] Patent Number: 5,129,354

[45] Date of Patent: Jul. 14, 1992

[54] ELECTROSTATIC IMAGE DEVELOPER PRODUCTION APPARATUS

[75] Inventors: Yoshiaki Koizumi, Hachioji; Kenji Tsujita, Fujino; Shigenori Kouno, Tachikawa; Ken Ohmura, Hachioji, all of Japan

[73] Assignee: Konica Corporation, Tokyo, Japan

[21] Appl. No.: 715,893

[22] Filed: Jun. 19, 1991

Related U.S. Application Data

[63] Continuation of Ser. No. 444,870, Dec. 4, 1989, abandoned.

[30] Foreign Application Priority Data

Dec. 13, 1988 [JP] Japan ..... 63-314162

[51] Int. Cl.[5] ..... B05C 19/06

[52] U.S. Cl. ..... 118/64; 118/69; 118/612; 118/DIG. 5

[58] Field of Search ..... 118/19, 20, 64, 69, 118/309, 312, 612, 627, 634, DIG. 5

[56] References Cited

U.S. PATENT DOCUMENTS

| | | | |
|---|---|---|---|
| 1,236,832 | 8/1917 | Frye | 118/612 |
| 1,989,800 | 2/1935 | Gustin | 118/612 |
| 2,375,766 | 5/1945 | Britcher | 118/612 |
| 4,454,177 | 6/1984 | Feist | 118/69 |

FOREIGN PATENT DOCUMENTS

| | | | |
|---|---|---|---|
| 662157 | 5/1979 | U.S.S.R. | 118/634 |

*Primary Examiner*—Michael G. Wityshyn
*Attorney, Agent, or Firm*—Finnegan, Henderson, Farabow, Garrett and Dunner

[57] ABSTRACT

An apparatus for producing an electrostatic image developer carrier from a material, comprising; a chamber for providing an enclosed space in which the material is processed, a stirrer for stirring the material in a horizontal direction in the chamber, and at least one of: a heater for heating up the chamber to a predetermined temperature, and a cooler for cooling down the chamber to a predetermined temperature.

3 Claims, 7 Drawing Sheets

ELECTROSTATIC IMAGE DEVELOPER PRODUCTION APPARATUS

This application is a continuation, of application Ser. No. 07/444,970, filed Dec. 4, 1989, now abandoned.

BACKGROUND OF THE INVENTION

The present invention relates to an electrostatic image developer production apparatus suitable for the production of an electrostatic image developer carrier.

The two component developer consisting of a toner and a carrier is advantageous in that the electrification characteristic and the electrification amount of the toner can be controlled to a considerable extent and that the colors to be given to the toner can be selected from a relatively wide range of colors.

For the carrier to be used in the two component developer, a coating carrier consisting of the core materials whose surfaces are covered with the coating resin for the higher durability and the improvement in the triboelectrification characteristic.

The production apparatus of the coating carrier, the fluid layer type apparatus, immersion type apparatus and sintering type apparatus are commonly known, but the fluid layer type apparatus is most widely used because of its high productivity.

The fluid layer type apparatus, however, has the drawbacks such as the high manufacturing cost due to the necessity of the affiliated devices such as the solvent recovery device to recover the waste solvent and the solvent burner and the safety problem due to using the inflammable solvent. In addition, the fluid layer type spray coating method has a certain limit in improving its productivity. For instance, increasing the number of sprays and the spray rate to increase the supply of the coating solution per unit time for higher productivity causes the gasification of the solution present among the core materials to be retarded to cause the solution to turn into the particles of unnecessarily large particle size. On the other hand, increasing the concentration of the solution results in the increase in the viscosity of the solution, which also causes the formation of the solution particles. Besides, in this method, it is essential for the coating resin to be dissolved into the solvent, so that the kinds of the usable resins are limited in terms of their molecular weights. Another drawback of this method is that it is difficult for the cores of the carrier to form the appropriate fluid layer because of their small individual masses resulting from their quite small particle size for realizing high-quality image and high developing efficiency, which results in poor coating efficiency.

Thus, there has been an increasing demand for the development of a new method, and recently, a dry method characterized by applying the impact on the resin particles to cause the particles to adhere to the cores has been developed.

The dry coating method has the following advantages:

(1) The cleansing and drying processes can be eliminated to substantially shorten the time required for coating.

(2) The granulating rate of the solution is relatively small, so that the carrier with the distribution corresponding to the cores which are provided in the form of the magnetic particles can be obtained as a high yield rate.

(3) Unnecessitating the solvent recovery device and the solvent burner, both the reduction of the manufacturing cost and higher safety can be realized.

(4) The quantitative ratio of the resin particles to the magnetic particles in the production apparatus can be reduced for using the materials with higher economy.

(5) The magnetic particles are extended with resin particles adhered to the surfaces of the magnetic particles, so that the hard-to-remove coating films can be formed to obtain high durability and stable triboelectrification characteristic.

(6) Permitting the use of the resins with relatively low solubility to the solvent, not only the resins can be selected within a much wider range but also the coating even with the fine particulate carrier can be made easily to obtain the coating carriers with different characteristics.

The dry coating device not using the solvent can roughly be classified into one using the heat to effect the fused bonding and the other using the mechanochemical effect.

As the examples of the former device, there are the furnace type device introduced in the Japanese patent laid open publication 118047/1980 and the Japanese patent publication 163544/1980, and the rotary furnace type device introduced in the Japanese patent laid open publication 170865/1985 and the Japanese patent publication 106475/1987. Another method of fused bonding using the high-speed stirrer to effect the bonding of the resin particles is disclosed in the Japanese patent laid open publication 27858/1988, through the construction of the device is not described in detail.

In the fused bonding methods using the heater, the temperature of the coating resin is raised above the softening or melting point, so that the cores of the carrier are bonded to each other through the resin which serves as the binder, and this causes the granulating effect due to the increase in the particle size. When the particle size becomes too large, the effect of the developing agent in the developing device becomes uneven to adversely affect the formation of the uniform and high-quality image.

Also, when the carrier obtained by breaking up the granulated carrier is not uniform in coating, thereby causing the unevenness in the triboelectrification characteristic of the toner and the resulting defect of the image such as the fog or the scattering of the toner. Furthermore, this method requires the processing at a high temperature, which poses the safety problem.

On the other hand, as the examples of the latter device, there is one disclosed in the Japanese patent laid open publication 235962/1988, wherein the impact is given by a rotary body disposed in vertical direction to circulate the carrier by moving the carrier upward, and, in this process, unnecessarily large impact is given to the carrier. Thus, when the sintered carrier such as the ferrite carrier is used, the carrier tends to develop the internal cracks to reduce the durability of the carrier.

If the carrier with internal cracks is used, the carrier will be broken up gradually as it is stirred in the developing device, and, as a result, the surfaces of the carriers not covered with the resin coating will be increased. Since the triboelectrification characteristic of the uncoated surfaces of the carrier differs from that of the surface of the carrier with resin coating, the triboelectrification characteristic of the toner will become unstable to deteriorate the image quality. Besides, the broken up particles have smaller particle sizes than the normal particles, so that the holding strength of smaller particles to the sleeve surface are weaker than those of the normal particles, and the smaller particles tend to move onto the photosensitive body (the electrostatic image holding body). As a result, the particles cause the deterioration of the image quality due to the adhesion of the carrier to the image or poor cleaning.

As described above, any complete device has not been developed as far as the dry type coating device is concerned.

Thus, an object of the present invention is to provide a carrier production apparatus capable of producing the carrier with the ability to form the even resin layer, high yielding rate and high durability.

SUMMARY OF THE INVENTION

The production apparatus according to the present invention comprises a horizontal rotary member to provide the impact to the material fed into a chamber and a heating and/or a cooling device to control the internal temperature of the chamber.

Furthermore, the production apparatus according to the present invention is preferred to have a function for enabling the material subjected to the impact from the horizontal rotary member to collide against the internal wall of the chamber by the centrifugal force and then return within the rotary range of the rotary blades of the horizontal rotary member.

The materials according to the present invention mean the materials to constitute the carrier such as the mixture of the core material of the carrier and the resin particles adhered to the surfaces of said core material, the surface-improving agent, which covers the surfaces of the core material, resin particles and the layer of coating, and the additives contained in the layer of coating but not limited to these materials.

The apparatus according to the present invention comprises a heating and/or a cooling device. Normally, the apparatus is preferred to comprise both the heating and the cooling devices but may comprise only one of the devices depending on the conditions of installation and the operating condition.

In the ordinary application, the heating device is used while the formation of the coating layer is in progress, whereas the cooling device is used after the formation of the coating layer is completed. The switching between the heating device and the cooling device is preferred to be made easily and promptly.

The heat exchange is made through the wall and/or the bottom of the chamber. The heating and/or cooling device may have the jacket construction through which the hot water or the cold water can be made to pass, or the construction that permits the hot or cold air to be blown against the outside of the chamber or blown into the inside of the chamber, or heating the chamber with the high frequency or infrared rays. Of these constructions, the jacket construction that allows the quick heating or cooling and is simple in construction is preferred.

The heating and/or cooling device is preferred to be installed on the wall of the chamber where the material is stirred well surrounding the outer circumference of the rotary member to rate in the horizontal and the upper part of the chamber wall. Also, said heating and/or cooling device is preferred to be installed on the bottom surface of the chamber.

The transition point as which the resin particle to be used for the coating of the carrier turns into the glass is preferred to be 65° C. or more, so that the heating device is preferred to be capable of maintaining the temperature of the object in the chamber at 65° C. or more.

The temperature of the object means the average of the approximate surface temperatures of the particles consisting of the cores and the resin particles covering the surfaces of the cores measured by a temperature measuring probe inserted into the mass of the particles fluidized due to the effect of the impact acting thereon so that the probe come into contact with the particles at random to measure the surface temperatures of the particles. The temperature measuring probe consists of a thermocouple and a resistance thermometer bulb and is capable of measuring the temperature of the object by electrically measuring its electromotive force and resistance. As the thermocouple, for example, a chromel-alumel thermocouple may be used.

The horizontal rotary member delivers the impulsive force to the material. The impulsive force is given as an energy to enable uniform coating to be formed on the surface of the core material without damaging the core material, and the impulsive force is given repetitively so that the resin particles adhere to the surface of the core material.

The apparatus according to the present invention is preferred to comprise a device capable of moving or blowing the material upward into the chamber so that the material collided against the internal wall of the chamber due to the effect of the impulsive force acting thereon is allowed to return within the rotary range of the blades of the horizontal rotary member.

Hereafter, the constructions of the upcasting device and upblowing device will be described, but the means for moving the material according to the present invention is not limited to these devices.

The upcasting device consists of the horizontal rotary member wherein the cross section of the blade is inclined at a specified angle or $\theta = 20°-60°$ to the rounding direction.

The upper portion of the chamber is preferred to have a smaller space than the rest of the portion. More specifically, the internal wall of the upper portion of the chamber is preferred to incline towards the center of axis of the horizontal rotary member. In this case, the internal wall of the lower portion of the chamber may be either parallel to or inversely inclined to the center of axis of the horizontal rotary member.

The upblowing device consists of a horizontal rotary member disposed in the chamber and air is emitted from a slit located in the bottom of the chamber. In the case of the upblowing device having this construction, the air needs to be blown at a considerably high intensity, so that the resin deposited on the surface of the core material of the carrier tends to be separated from the surface and scattered about the system before forming the coating on the surface of the core material. Contrastingly, in the case of the upcasting device, the necessary intensity of the air blow is much smaller, since only the air blow with an intensity large enough to provide the air-sealing to the axis of rotation.

Thus, in the case of the upcasting device, the coating can be accomplished at a greater ratio to the fed quantity of the material and at a greater efficiency compared with those in the case of the upblowing device. In addition, in the case of the former device, the fine particles of the carrier tend to be scattered about the system, so that the uniform coating can be formed more easily.

Thus, the upcasting device is better suited for the production of the carrier in the form of fine particles and also for the formation of the effective coating at a greater ratio and a greater uniformity, so that the upcasting device is more widely employed.

The apparatus according to the present invention may comprise a vertical rotary member for more efficient dry type coating.

The average particle size of the core material by weight is 10–200 μm, whereas the size of the resin particle is preferred to be within the range of 0.01–2 μm. When the resin particles within this particles size range are used, the coating carrier can be obtained at a higher yield rate, but the most preferred size of the resin particle is within 0.01–0.5 μm.

The production apparatus according to the present invention can also be used for the production of the carrier material consisting of the cores and the resin particles adhered to the surfaces of the cores.

The particles of the toner to be used together with the carrier produced by the production apparatus according to the present invention consists of the positively or negatively electrified particles of the resin and/or the positively or negatively electrified toner particles including the coloring agent.

The mixing ratio by weight between the carrier and toner particles to be produced by the production apparatus according to the present invention may be any ratio, but the preferred ratio of the toner particles to the carrier is within 1:99–10:90, and the most preferred ratio is within 2:98–8:92.

The carrier and the toner may be mixed according to the normal procedure.

The dry type coating device for electrophotography use comprises a horizontal rotary member and a heating and/or cooling device.

The horizontal rotary device upcasts the material while exerting the impulsive force on the material. The upcast material collides against the inclined internal wall of the chamber to bounce back into the rotary range of the blade of the horizontal rotary member. Thus, the impulse force can be exerted on the material efficiently and evenly to facilitate the mechanochemical effect on the material. In this case, where the internal wall of the chamber is inclined inwardly, the upcast material can be brought back efficiently into the rotary range of the blade.

The material upblown by the air from the slit can also be subjected efficiently and evenly to the impulsive force to facilitate the mechanochemical effect on the material.

In the coat forming process, in order to obtain the carrier with high coat forming ability, it is preferred to appropriately soften the resin particles adhered to the surface of the core material by maintaining the temperature of the object at the level near the glass transition point.

According to the present invention, the temperature of the object in the chamber can be varied by providing the heating and/or cooling device so that the appropriate temperature of the object matching with the conditions of the production environment can be selected depending on the kind of the resin particles.

Besides, after completing the coat forming process, the inside of the chamber can be cooled quickly to the room temperature, so that the carrier can be prevented from being discharged while being subjected to the temperature near the temperature of the glass transition point and the coagulation among the carriers can also be prevented.

As described above, the production apparatus according to the present invention is not only capable of facilitating the mechanochemical effect on the material to form the coat at an appropriate temperature of the object but also capable of producing the carrier with the uniform, highly effective and highly durable coating without the granulation, since the quick cooling can be effected following the completion of the coat forming process.

BRIEF DESCRIPTION OF THE DRAWINGS

FIG. 3-*b* is an enlarged view of the essential part of the horizontal rotary member shown in FIG. 3-*a*.

DETAILED DESCRIPTION OF THE INVENTION

Hereafter, the preferred embodiments of the present invention will be described. However, it is to be understood that the invention is not intended to be limited to the specific embodiments.

Embodiment-1

The dry type coating device represented by Embodiment-1 will be described referring to FIGS. 1, 2, 3 and 4.

Figure 1:
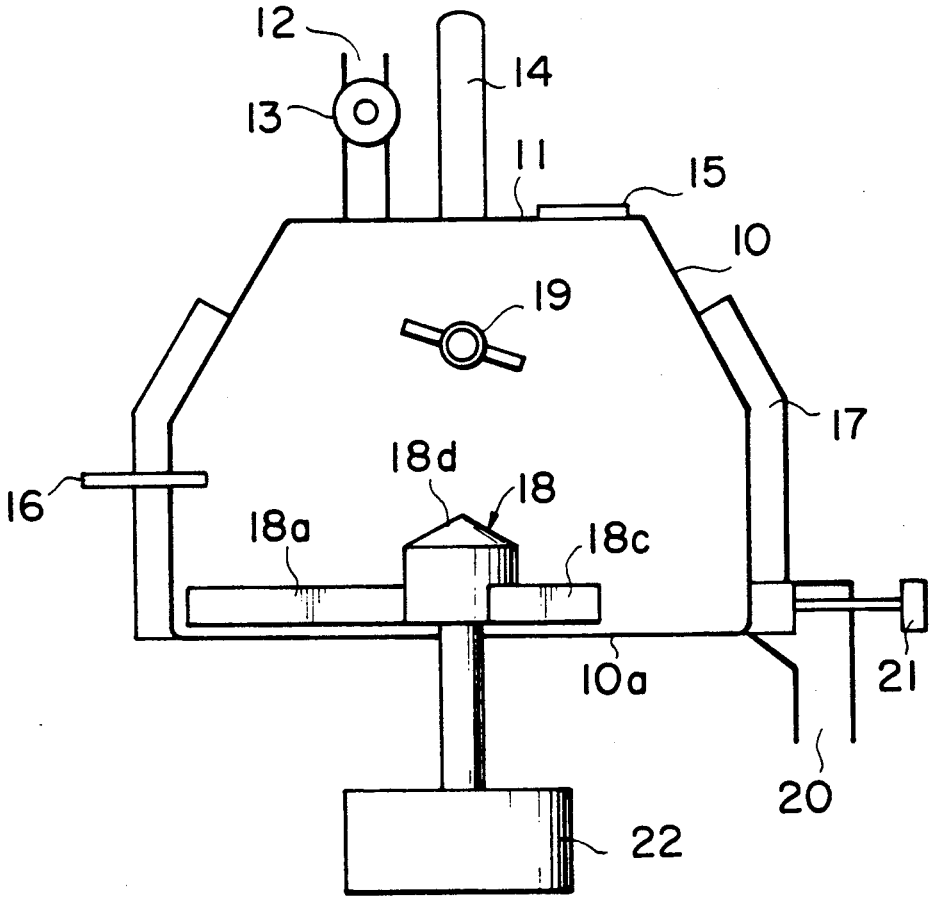
FIGS. 1 and 5 show the cross-sectional views of the dry type coating carrier production apparatuses as the preferred embodiments of the present invention.
Figure 2:
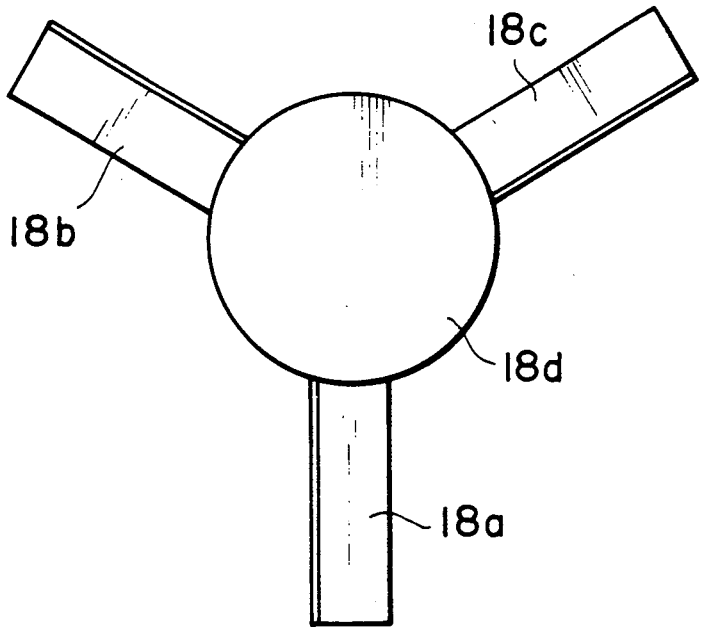
FIG. 2 is a plan view of the horizontal rotary member 18 shown in FIG. 1.
Figure 3A:
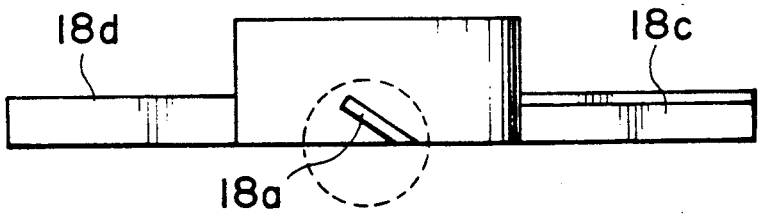
FIG. 3-*a* is a cross-sectional view of the horizontal rotary member 18 shown in FIG. 1.
Figure 3B:
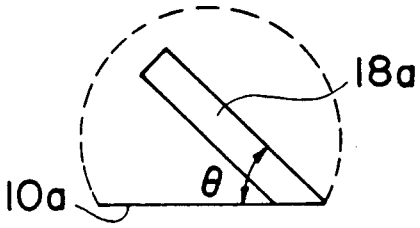
Figure 4:
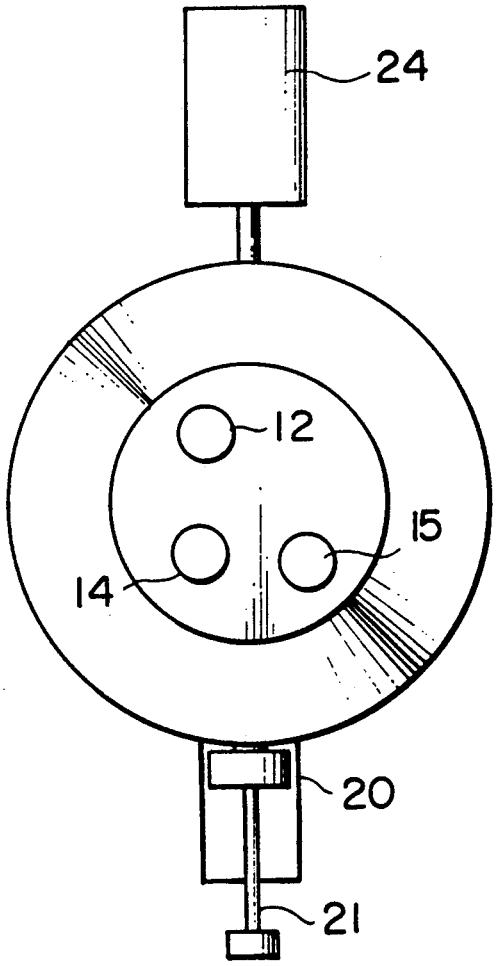
FIG. 4 is a plan view of the dry type coating carrier production apparatus shown in FIG. 1.

FIG. 1 is an explanatory drawing schematically illustrating the construction of the dry type coating device. FIGS. 2, 3-*a* and 3-*b* are the plan view, the cross-sectional view and the enlarged view of the essential part of the horizontal rotary member respectively. FIG. 4 is a plan view of the apparatus of the present invention.

The top cover 11 of the main unit is provided with the material inlet 12 with the feed valve 13, the filter 14 and the inspection hole 15.

The material fed from the material inlet 12 through the feed valve 13 is subjected to the impulsive force by the horizontal rotary member 18 driven by the motor 22.

As illustrated in FIG. 2, the horizontal rotary member 18 comprises the central part 18*d* and the blades 18*a*, 18*b* and 18*c*. As illustrated in FIGS. 3-*a* and 3-*b*, each blade is disposed at an angle of 35° to the bottom 10*a* of the container 10 of the main unit, and thus the material can be cast upward. The front end of each blade of the horizontal rotary member 18 is disposed in the same direction as that of the internal wall of the lower portion of the chamber.

The upcast material is made to collide against the internal wall of the upper portion of the chamber including towards the center of the horizontal rotary member 18 or the internal wall of the lower portion of the chamber to drop into the rotary range of the blades 18*a*, 18*b* and 18*c* of the horizontal rotary member.

In this embodiment, the vertical rotary member 19 is disposed above the horizontal rotary member 18. The vertical rotary member 19 with two blades rotates in the up-and-down direction to collide against the material bounced back from the internal wall of the chamber. Thus, the vertical rotary member 19 facilitates the stirring of the material to break up the coagulated material.

Although the horizontal rotary member 18 also breaks up the coagulated material, the breaking up can be made more efficiently by using the vertical rotary member.

The material is subjected to the impulsive force exerted from the horizontal rotary member 18, the vertical rotary member 19, by colliding against the internal wall of the chamber and by the collision between the particles of the material, and, as a result, the resin particles are caused to adhere to the surface of the core material. The coated carrier is discharged from the product outlet 20 through the opened discharge valve 21.

Jacket 17 covers up to three quarters of the height of the external wall of the chamber or up to the location of the vertical rotary member 19. The jacket 17 normally serves as a heating device when stirring the material and also serves as a cooling device after completing the stirring process, though the operating condition of the jacket varies depending on the glass transition point of the resin particles and the temperature of the object in the chamber.

The temperature of the object is measured with the object temperature thermometer 16. The object temperature thermometer 16 is a chromel-alumel thermocouple (T40-K-2-6,4-100-U-304-KX-G-3000 manufactured by Hayashi Denko Co., Ltd.) with a stainless steel cover (SUS304) 10 cm in length and 6.4 mm in diameter. This object temperature thermometer is inserted into the container 10 at the point, at about one third of the height of the container, so as to be parallel to the bottom 10*a* of the container and towards the center of the horizontal rotary member 18, in order to be installed on the container 10. The object temperature thermometer is inserted so as to come above the blade of the horizontal rotary member covering about one fifth of the blade being measured from the end of the blade.

In this embodiment, the vertical rotary body 19 is provided with two blades, but the three blades or more may be provided.

Also, in this embodiment, the vertical rotary member 19 is provided, but this member may be omitted.

Embodiment-2

Figure 5:
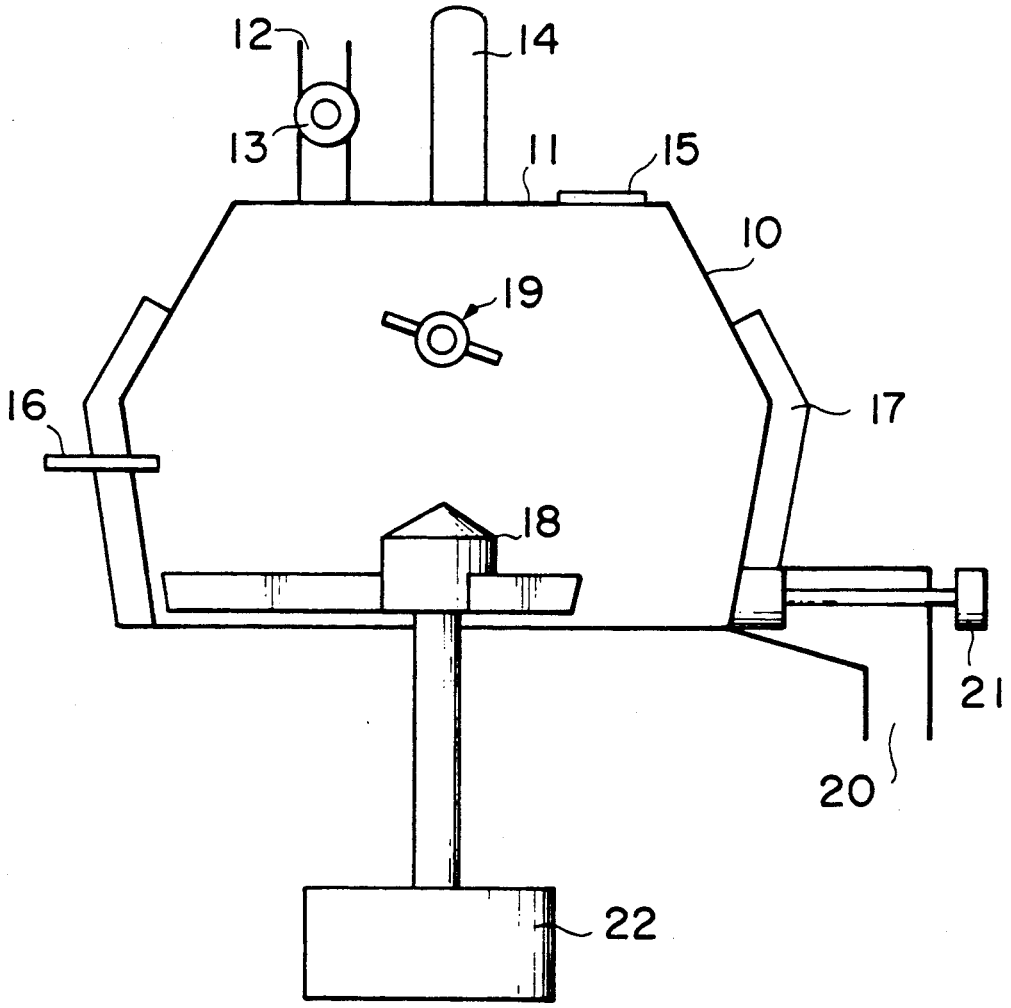

FIG. 5 schematically shows the construction of the dry type coating device of Embodiment-2. In this embodiment, the construction consisting of the members 10 through 22 is the same as that of Embodiment-1.

The shape of the container 10 in Embodiment-2 differs from that of Embodiment-1.

In Embodiment-2, the internal wall of the lower portion of the chamber is inclined inversely in the direction of the center of rotation of the horizontal rotary member, whereas the internal wall of the upper portion of the chamber is inclined towards the center of rotation. That is, the above-described chamber is shaped so that the diameter is largest at the central portion between the top and the bottom of the chamber.

For that reason, the material collided against the internal wall of the lower portion of the chamber is bounded back towards the internal wall of the upper portion of the chamber, and the material is likely to drop onto the central portion of the blades.

The front end of the blade of the horizontal rotary member 18 faces the same direction as that of the internal wall of the lower portion of the chamber and is inclined inversely in the direction of the center of rotation of the horizontal rotary member.

In this embodiment, the vertical rotary member 19 is provided, but this member may be omitted.

Embodiment-3

Figure 6:
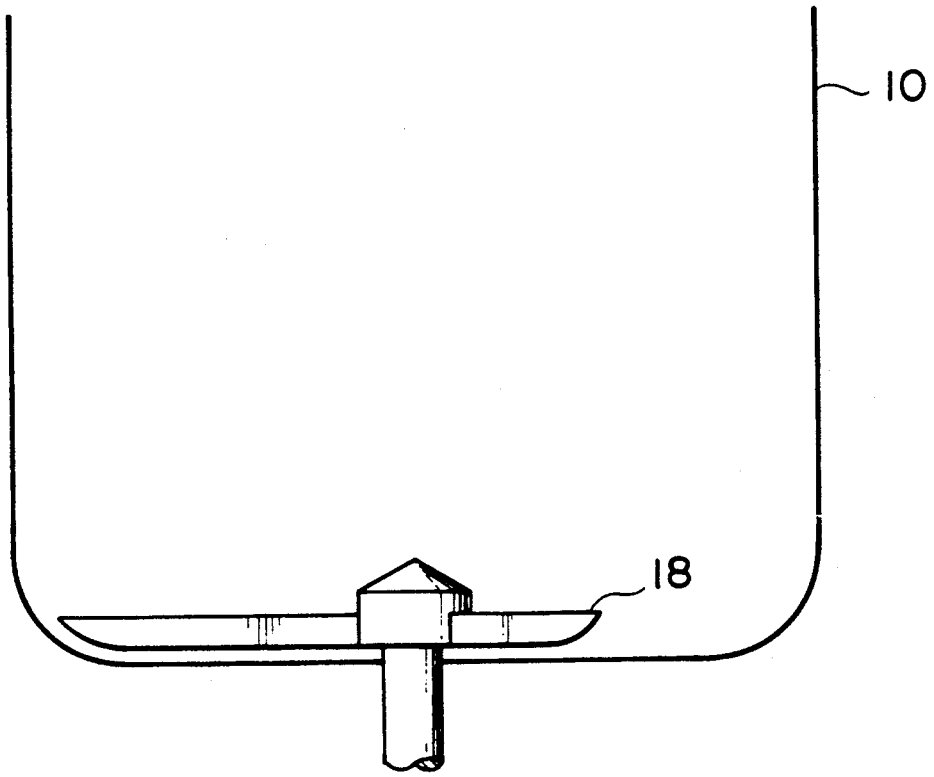
FIGS. 6 and 7 are the sectional views of a different dry type coating material production apparatus.

This embodiment will be described referring to FIG. 6. FIG. 6 shows the horizontal rotary member 18 and the shape of the container 10.

The container 10 has a cylindrical shape and contains the horizontal rotary member similar to that of Embodiment-1. The outer circumferential portion of the bottom of the chamber is bent upward to give the upward kinetic energy to the material cast outward by the centrifugal force for stirring the material.

The front end of the blade of the horizontal rotary member 18, however, faces the same direction as that of the internal wall of the lower portion of the chamber, and the above-described front end is bent upward.

The rest of the construction is the same as that of Embodiment-1.

Embodiment-4

Figure 7:
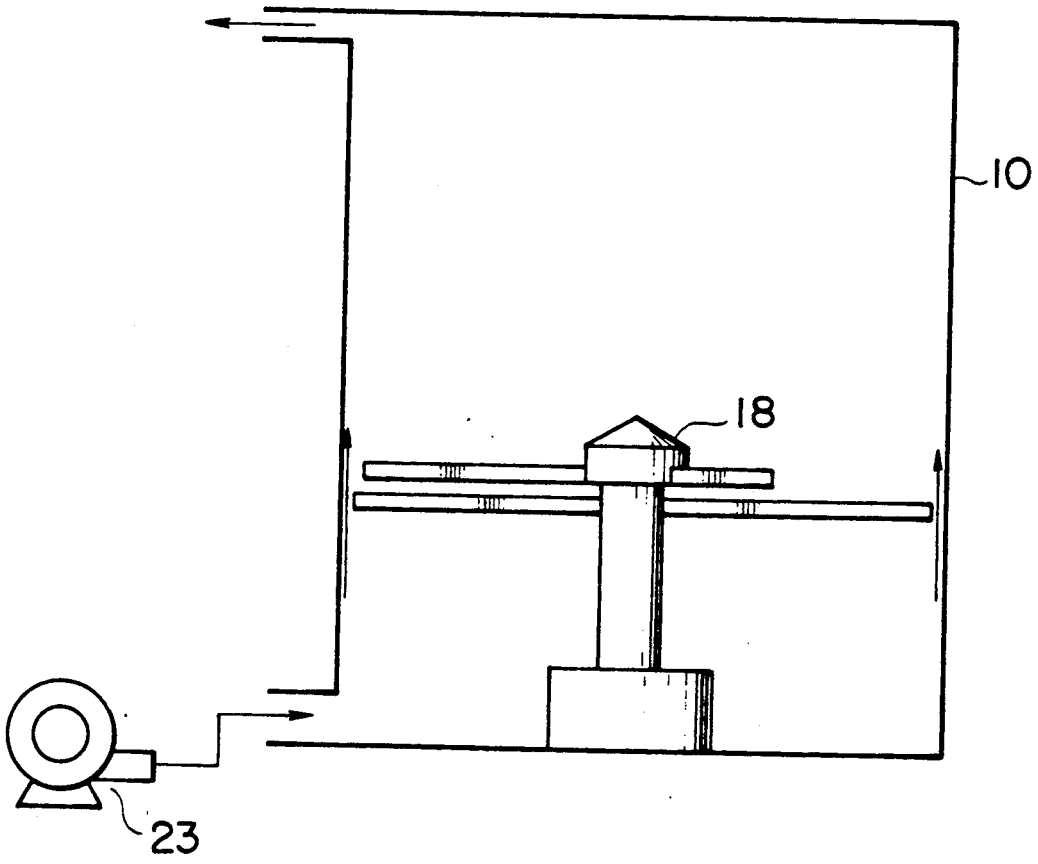

Embodiment-4 will be described referring to FIG. 7. The chamber contains the horizontal rotary member 18 and the air is blown upward through the slit 23 provided at the bottom to upcast the mixture by the air. The arrow indicates the direction of air flow. In this case, the desired heating can be accomplished effectively by heating the air.

Comparative Example-1

Figure 8:
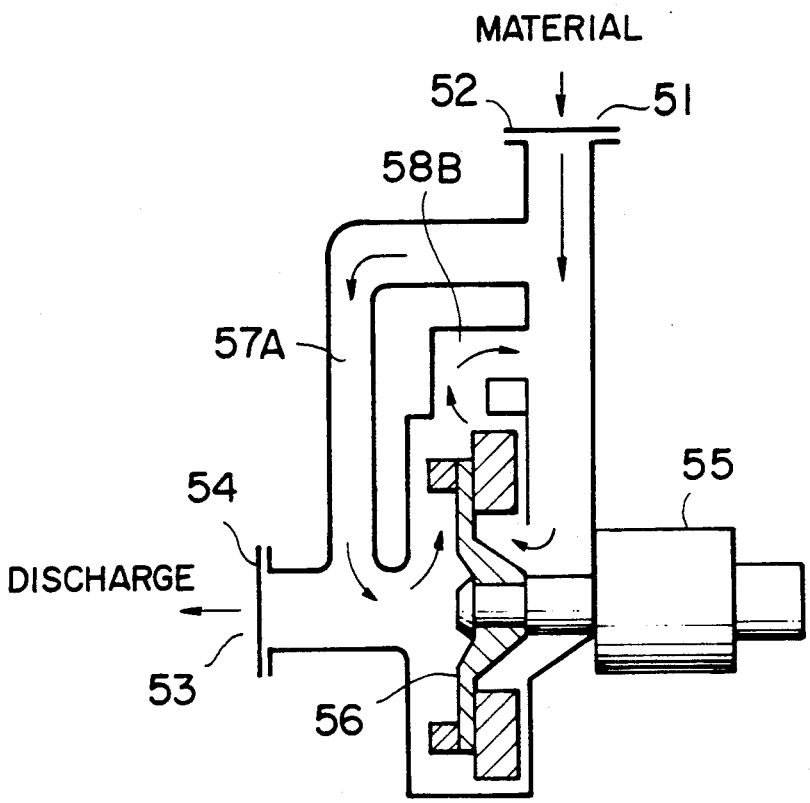
FIG. 8 PRIOR ART
FIGS. 8 and 9 are conventionally known dry type coating apparatus.

A conventional dry type coating device will be described referring to FIG. 8.

The numeral 51 denotes a material chute; 52, an inlet cover; 53, a product outlet; 54, an outlet cover; 55, a stirring motor; 56, a rotary blade; and 57A and 58B, the pipings for recycling.

In this apparatus, the material fed from the material chute 51 is given the impulsive force from the rotary blade 56 to cause the resin particles deposited on the surface of the core material to adhere firmly to the surface. Then, the above-described particles pass through the recycling piping 57A or 58B to be struck again by the rotary blades. This process will be repeated to accomplish the desired dry type coating. Comparative Example-2

Figure 9:
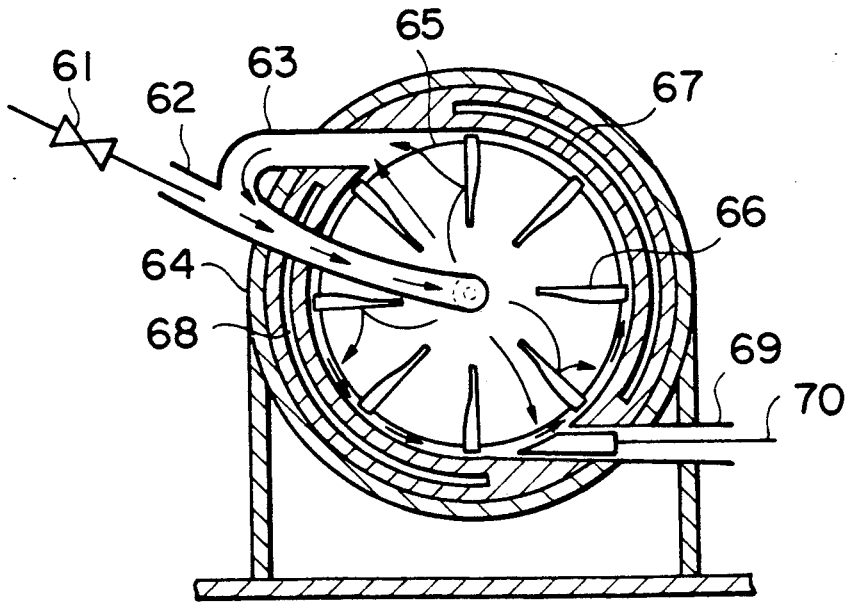
FIG. 9 PRIOR ART

Another conventional dry type coating device will be described referring to FIG. 9.

The numeral 61 denotes a material feed valve; 62, a material chute; 63, a recycling circuit; 64, a casing; 65, a rotary disc; 66, a blade; 67, a stator; 68, a cooling or heating jacket; 69, a material discharge chute; and 70, a material discharge valve.

The material fed through the material chute 62 will circulate through the recycling circuit 63. In this recycling process, the material collides against the blades 66 to receive the impulsive force therefrom, whereby the resin particles deposited on the surface of the core material are caused to adhere firmly to the surface to provide the carrier with dry type coating.

In order to control the internal temperature of the apparatus, the recycling circuit 63 and the material chute 69 may be cooled or heated by the jacket 68.

Hereafter, the examples of the production of the carrier using the embodiments of the present invention and the production apparatuses of the comparative examples will be explained.

In the production apparatus described in Embodiment-1, the dry type coating device not comprising the vertical member 19 was used.

In this embodiment, the resin particles with the average particle size of 0.4 μm, 0.4 wt % in quantity, were added to the copper-zinc ferrite with the weight average particle size of 80 μm and stirred with a YGG mixer for 20 minutes to obtain the mixture of these materials.

The mixture was fed into the production apparatus, and the mixture was subjected to the impulsive force for 15 minutes while hot water was circulated through the jacket to maintain the temperature of the mixture at 80° C. Then, cooling water was circulated through the jacket to cool the mixture down to 40° C. In this case, the circumferential speed of the rotary disc was 10 m/sec.

The result of the observation of the obtained carrier by a scanning electron microscope indicated that a uniform resin coating was formed.

Then, the example of the production using the production apparatus described in Embodiment-2 will be explained. In this example, the resin particles with the average particle size of 0.10 μm, 0.8 wt % in quantity, were added to the copper-zinc ferrite with the average particle size of 40 μm and stirred for 20 minutes with a YGG mixer to obtain the mixture of these materials.

The mixture was then fed to the apparatus described in Embodiment-1 to produce the carrier under the same conditions as were described previously.

The result of the observation of the obtained carrier by a scanning electron microscope indicated that the uniform resin coating was formed.

Then, another example of the production using the apparatus described in Comparative example-2 will be explained.

In this example, the resin particles with the average particle size of 0.40 μm, 0.4 wt % in quantity, were added to the copper-zinc ferrite with the weight average particle size of 80 μm and stirred with a YGG mixer for about 20 minutes to obtain the mixture. The obtained mixture was fed to the apparatus described in Comparative example-2 and subjected to the impulse force for 8 minutes while hot water was circulated through the jacket to maintain the temperature of the mixture at 80° C. Then, cooling water was circulated through the jacket to lower the temperature of the mixture to 60° C. In this case, the circumferential speed of the rotary disc was 20 m/sec (When the circumferential speed is lower than 20 m/sec, the carrier core cannot be upcast, and this causes the coating to be formed unevenly).

In this production method, the carrier was subjected to too intensive impulsive force. In this case, therefore, the result of the observation of the obtained carrier by a scanning electron microscope indicated that the resin coating was formed unevenly.

As discussed in the above, the production apparatus of the present invention was capable of producing the carrier with uniform resin coating at a high coating ratio, whereas the carrier produced by the apparatus described in Comparative example was found to have a little lower coating ratio. The result of the evaluation of the carrier using the commercial production apparatus indicated that the carrier produced by the method of the Comparative example formed defective images due to the blur and the scattering of the toner when several tens thousand copies were taken, whereas the carrier produced by the method described in the embodiment of the present invention proved to be free of any problems according to the result of the durability test conducted by taking 60,000 copies.

What is claimed is:

1. An apparatus for producing an electrostatic image developer carrier from a particle material which has a diameter between 10 μm and 200 μm, comprising:

a chamber means for providing an enclosed space wherein said particle material is coated with a coating particle which has a diameter between 0.01 μm and 2 μm;

a first stirring means rotatable about a vertical axis and having a blade means inclined at an angle between 20° and 60 ° with respect to the horizontal for stirring said material in a horizontal direction in said chamber means;

a second stirring means in said chamber means rotatable in a vertical plane about a horizontal axis; and means for heating said chamber means to a first predetermined temperature and for cooling said chamber means to a second predetermined temperature.

2. The apparatus claim in claim 1, wherein the chamber means has an upper portion and a lower portion, the apparatus further comprising means for blowing air through said material upwardly from the lower portion toward the upper portion to force the material upwards in said chamber means.

3. The apparatus claimed in claim 2, wherein said upper portion includes walls extending from a lowermost part of the upper portion to an uppermost part of the upper portion, the uppermost part being narrower than the lowermost part.

* * * * *

UNITED STATES PATENT AND TRADEMARK OFFICE

CERTIFICATE OF CORRECTION

PATENT NO. : 5,129,354

DATED : July 14, 1992

INVENTOR(S) : Yoshiaki Koizumi et al.

It is certified that error appears in the above-identified patent and that said Letters Patent is hereby corrected as shown below:

Claim 2, column 10, line 41, change "claim" (first occurence) to --claimed--.

Signed and Sealed this

Fourteenth Day of September, 1993

Bruce Lehman

*Attest:*

BRUCE LEHMAN

*Attesting Officer*

*Commissioner of Patents and Trademarks*